US007444784B2

(12) United States Patent
Brown

(10) Patent No.: US 7,444,784 B2
(45) Date of Patent: Nov. 4, 2008

(54) WINDOW WELL COVERING SYSTEM

(75) Inventor: Alexander Brown, Denver, CO (US)

(73) Assignee: Safe-T-Rail Co., Commerce City, CO (US)

( * ) Notice: Subject to any disclaimer, the term of this patent is extended or adjusted under 35 U.S.C. 154(b) by 373 days.

(21) Appl. No.: 10/991,760

(22) Filed: Nov. 17, 2004

(65) Prior Publication Data

US 2005/0150177 A1 Jul. 14, 2005

Related U.S. Application Data

(60) Provisional application No. 60/520,921, filed on Nov. 17, 2003.

(51) Int. Cl.
*E06B 3/30* (2006.01)

(52) U.S. Cl. ..... 52/107; 52/66; 52/69; 52/202; 292/266; 292/268; 49/395

(58) Field of Classification Search ..... 52/127.7, 52/127.9, 127.8, 169.6, 202, 203, 64, 66, 52/69; 49/395, 394; 16/380, 19; 292/266, 292/267, 262, 269, 265, 270, 271, 272; 248/251; 256/73

See application file for complete search history.

(56) References Cited

U.S. PATENT DOCUMENTS

| | | | | | |
|---|---|---|---|---|---|
| 1,531,785 | A | * | 3/1925 | Hein | 296/95.1 |
| 1,600,171 | A | * | 9/1926 | Hixon | 292/262 |
| 1,715,208 | A | * | 5/1929 | Micklin | 52/507 |
| 1,915,417 | A | * | 6/1933 | Harbert | 292/283 |
| 1,939,954 | A | * | 12/1933 | Campbell | 292/162 |
| 2,175,861 | A | * | 10/1939 | Wall | 49/261 |
| 2,718,039 | A | * | 9/1955 | Dube | 49/388 |
| 3,869,886 | A | * | 3/1975 | Diaz | 70/93 |
| 3,896,588 | A | * | 7/1975 | Doffin et al. | 49/394 |
| 3,989,291 | A | * | 11/1976 | Hucknall | 292/262 |
| 4,286,372 | A | | 9/1981 | Batcheller | |
| 4,638,596 | A | * | 1/1987 | Gallardo | 49/56 |
| 4,757,704 | A | | 7/1988 | Dresbach | |
| 5,593,141 | A | * | 1/1997 | Cain et al. | 256/26 |
| 5,657,578 | A | * | 8/1997 | Thompson | 49/141 |
| 6,450,261 | B1 | | 9/2002 | Baugh | |

FOREIGN PATENT DOCUMENTS

| | | | | |
|---|---|---|---|---|
| JP | 5-57535 | * | 3/1993 | 52/127.7 |

* cited by examiner

*Primary Examiner*—Phi Dieu Tran A
(74) *Attorney, Agent, or Firm*—Heimbecher & Assoc., LLC

(57) ABSTRACT

A system for temporally or permanently securing a removable window well cover or grid over a window well at, for example, a construction site is disclosed using adjustable mounts. The window well cover or grid may be pivoted open and closed without having to fully remove the window well cover from the opening of the window well. The adjustable mounts may include a grid sleeve unit slideably attached to the window well cover, and a lock keeper slideably mounted on the grid sleeve unit. In one aspect, the adjustable mounts include theft-deterring features that inhibit unauthorized removal of the window well cover from the window well.

11 Claims, 6 Drawing Sheets

WINDOW WELL COVERING SYSTEM

CROSS-REFERENCE TO RELATED APPLICATIONS

This application claims the benefit of U.S. provisional application No. 60/520,921, filed 17 Nov. 2003, which is hereby incorporated by reference as though fully set forth herein.

BACKGROUND OF THE INVENTION a. Field of the Invention

The instant invention is directed toward a window well covering system. More specifically, it relates to a removable and adjustable window well covering, including a theft-deterrent mounting system.

b. Background Art

In particular situations, it is necessary to be able to temporarily cover a window well using a removable window well cover. In the past, however, many of these temporary or removable window well covers have been removed from the window wells without authorization from the owner of a building. This may occur, for example, when a contractor or a subcontractor working on a building under construction removes the window well cover for easy access to a subterranean structure like the basement of the building. The contractor or subcontractor may, for example, desire to store equipment in the basement, and the easiest way to place the material in the basement may be through a basement window. Thus, an individual may remove the window well cover while inserting materials through the basement window and then fail to re-install the window well cover, setting the stage for potential problems. Also, when the window well cover is not re-installed over the window well, some individuals may feel free to take the window well cover from the property, which results in added expense for the proprietor of the building who must replace the stolen window well cover.

Even when a window well cover is properly placed over a window well and properly re-installed after having been temporarily removed for access to the basement, in the past it also has been difficult to prevent unauthorized individuals from removing the window well cover and stealing it.

When a window well remains uncovered due to someone's failure to properly replace the window well cover, or due to the theft of the window well cover, there is a potential for someone to fall into the uncovered window well.

In several jurisdictions, laws require that means for easy egress from a subterranean structure be provided. For example, in some states basements must include windows having a total surface area equal to at least 10% of the total square footage of the basement. In other words, a 1000 square foot basement would require at least 100 hundred square feet of windows to comply with such laws. Further, the lowest sill of each basement window can be no more than forty-two inches from the floor so that the window may easily be used as an exit. Such laws result in deep window wells that can be problematic from a safety perspective for at least the reasons noted above. In particular, with large windows and low sills, window wells may be very deep and dangerous, and there have been cases of severe injuries from construction workers falling into uncovered window wells. In view of these recognized issues, it is well known to cover window well openings to inhibit injuries that may be caused from falls into an uncovered window well and to deter unauthorized access to a building through the windows in a window well. Thus, various systems and structures exist for covering window wells. None of these known systems, however, permit rapid installation and removal of a secure window well cover. With some existing systems for covering window wells, it may take an hour or more to install each window well cover, which is an unacceptable amount of time from an economic standpoint for installing temporary protection. Thus, there remains a need for a rapidly installable, yet secure, temporary window well covering.

There are three primary or typical window well sizes: 48 inches, 58 inches, and 68 inches. Thus, it should be necessary to have only three primary sizes for window well covers. Window wells, however, may become deformed during shipping, making it necessary to be able to adjust window well coverings accordingly. For example, when shipping tin window wells, a company may smash or press a group of window wells together to reduce shipping volume. Thus, the outer window well in the compressed stack will have a shape that is different from the shape of the inner window well in the same stack. Also, tin window wells may be bolted to the side of the foundation and then back filled with dirt. The back filling frequently distorts the shape of the window well further. All these factors contribute to the somewhat random and varied configurations that often exist with installed window wells. Thus, there remains a need for some easy system for fitting a single window well cover to a variety of slightly different window well configurations.

Clearly, there remains a need for a window well cover that may be rapidly mounted over and removed from a window well opening, that provides ready access to the basement without having to fully remove the window well cover from the window well opening, and that is relatively difficult for unauthorized individuals to remove from the window well.

BRIEF SUMMARY OF THE INVENTION

It is desirable to be able to be able to cover window well openings, both permanently and temporarily, with a grid member or covering that may be opened and closed without having to fully remove the window well cover from the opening of the window well. Further, it remains desirable to attach this window well cover to a window well in a manner that inhibits unauthorized removal of the window well cover from the window well. Accordingly, it is an object of the disclosed invention to provide an improved window well covering system.

The window well covering system according to the present invention may be used, for example, to temporally secure a removable window well cover over a window well at a construction site. The window well cover or "cover grid" may be easily opened and closed by pivoting the cover grid in two adjustable mounts. With the cover grid and its adjustable mounts secured in place over the opening of a window well, the cover grid remains easy to pivot open and closed, while being difficult for an unprepared thief to steal.

In one form, the present invention comprises a covering that is removably mountable to a top edge of a window well. The covering comprises a cover grid having a cover grid edge; and at least one adjustable grid mount adapted to removably attach the cover grid to the window well by hingedly attaching the cover grid edge to the top edge of the window well. The adjustable grid mount may further comprise a grid sleeve unit slideably attached to the cover grid edge; and a lock keeper slideably mounted on the grid sleeve unit. The lock keeper may be adapted to rock on the grid sleeve unit and thereby lock the keeper to the grid sleeve unit. In this manner, adjustments may be made for different window well sizes. The grid cover may comprise a plurality of grid members or tubes, including an edge grid member or tube.

In another form, the present invention comprises a pivotable cover system for alternatingly covering and uncovering a window well. The cover system comprises (a) a pivotable cover grid comprising a plurality of grid members, including a mounting grid member; and (b) a pair of adjustable mounts, including a first adjustable mount and a second adjustable mount, wherein the first and second adjustable mounts are removably attached to the mounting grid member of the pivotable cover grid, and wherein the first and second adjustable mounts are adapted to attached the pivotable cover grid to the window well. Each of the first and second adjustable mounts may further comprise a grid sleeve unit slideably mounted on the mounting grid member; and a lock keeper slideably mounted on the grid sleeve unit.

With the disclosed window well covering system, it is also to accommodate many of the fluctuations in window well configurations that result from shipping, using only a limited number of cover grid sizes (e.g., a 58-inch wide cover grid, a 68-inch wide cover grid, and a 78-inch wide cover grid).

In the present invention, the window well cover grid may be pivoted off the window well to permit access to the basement, whether egress or ingress. The present invention also permits attachment of the window well cover to the window well without damaging or altering the window well itself.

The foregoing and other aspects, features, details, utilities, and advantages of the present invention will be apparent from reading the following description and claims, and from reviewing the accompanying drawings.

DETAILED DESCRIPTION OF THE INVENTION

Figure 1:
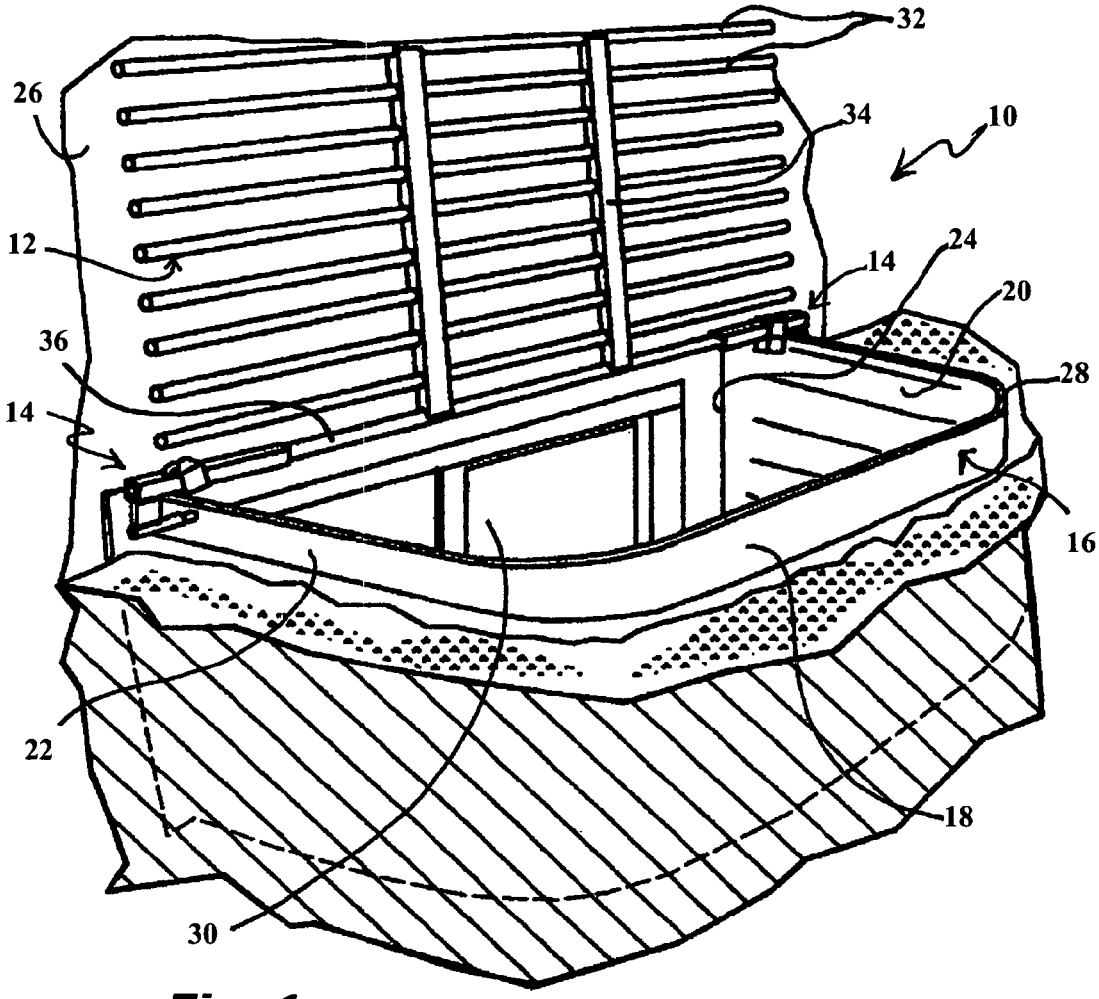
FIG. 1 is an isometric view of a window well covering according to the present invention in place above an upper edge of a window well, with a cover grid in an open configuration.

The present invention comprises a window well covering system 10, including a cover grid 12 and an adjustable mounting system 14 for the grid. An advantage of the present invention over the prior art is that the cover grid or lid 12, which may be adjusted (e.g., cut) to fit a variety of different window well openings, is pivotally and removably mounted over a window well 16. Thus, the cover grid 12 may be pivoted onto and off of the window well 16 as desired. Further, even though the cover grid 12 may be pivoted and removed, the instant invention includes a pair of adjustable mounts 14 that permits the cover grid 12 to be quickly installed and removed, yet inhibit undesirable, expensive, and potentially dangerous removal of the cover grid 12 by unauthorized parties.

Figure 2:
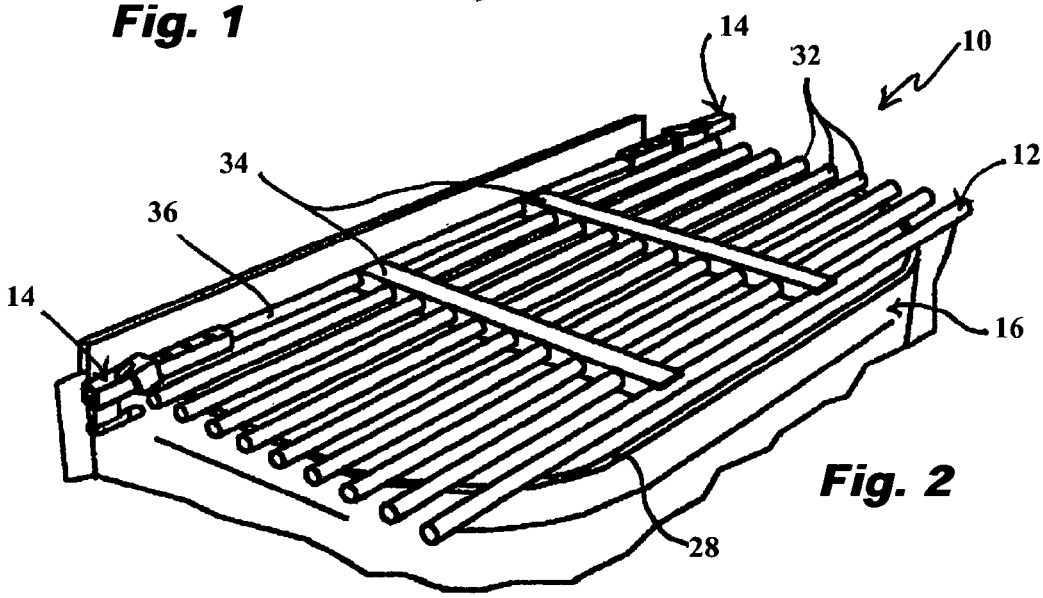
FIG. 2 is an isometric view similar to FIG. 1, but depicts the cover grid in a closed configuration.

Referring first to FIGS. 1 and 2, the window well covering system 10 according to the present invention comprises the cover grid 12 and the adjustable mounts 14, one mount at each end of the cover grid, to secure the cover grid to the window well. As depicted in FIGS. 1 and 2, a typical window well has a U-shaped cross section. The U-shaped cross section includes a base 18 and a pair of legs (20, 22). The base of the "U" defines the front wall of the window well, and the legs of the "U" define the side walls of the window well. Each window well leg terminates at a free edge 24 that rests against a structural wall 26 of a building when the window well is properly placed.

When the window well is in position, with the free edges 24 of its legs (20, 22) resting against the structural wall 26 of the building, an upper edge 28 of the window well defines an opening that provides access to, for example, a subterranean entrance to the building (e.g., a basement window 30). The window well may be held in position against the structural wall 26 by bolts or screws or glue, or merely by back-filled dirt or concrete. The opening defined by the upper edge 28 of the window well provides convenient access to the subterranean entrance to the building, but also provides a potential danger. In particular, it is possible for people who are not paying adequate attention to fall into an uncovered window well. The window well covering system 10 according to the present invention mitigates some of that danger while not eliminating easy access to the subterranean portion of the building through, for example, a basement window 30.

As clearly shown in FIGS. 1 and 2, the cover grid 12 according to one embodiment comprises a plurality of grid members 32 and one or more cross members 34. The grid members 32, which include a rear or first or edge grid member 36 most closely adjacent to the structural wall of the building, may come in a variety of diameters and lengths to span different size window well openings. Alternatively, the grid members 32 may be adjusted on-site if needed, by cutting them to length.

Figure 11:
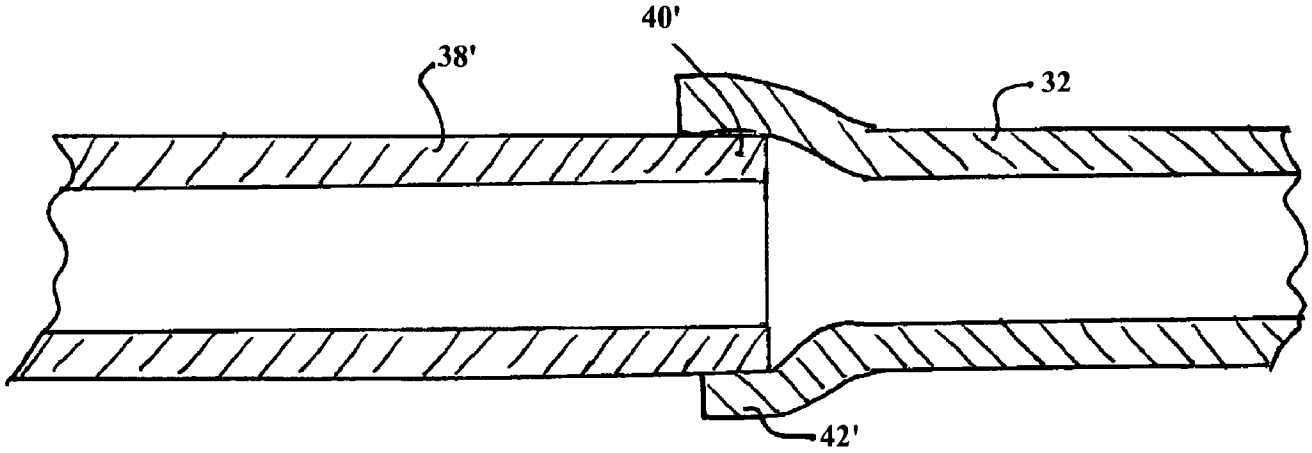
FIG. 11 is a fragmentary, cross-sectional view of a grid extension with its longitudinal end inserted into a swedged longitudinal end of a grid member
Figure 10:
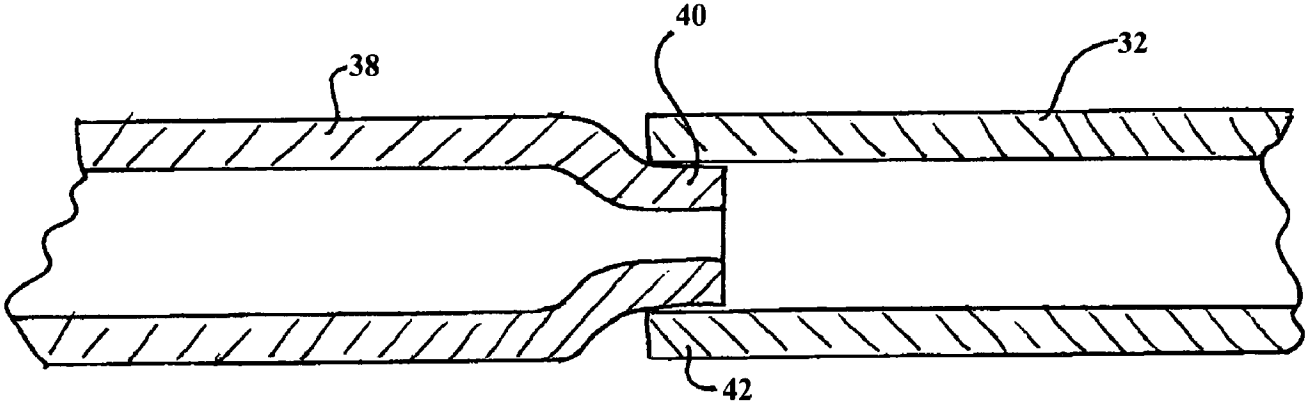
FIG. 10 is a fragmentary, cross-sectional view of a grid extension having a swedged longitudinal end inserted into a longitudinal end of a grid member.

In one form of the instant invention, the grid members 32 (or 36) comprise hollow tubes. Thus, if a grid member 32 is too short to span the window well opening for a particular installation (e.g., if the grid member was cut during a previous installation to fit over a relatively smaller window well 16), the grid member 32 may be extended using a grid extension 38 (FIG. 10) or 38' (FIG. 11), such as a second piece of grid member material. For example, the grid extension 38 may have a swedged end 40 that fits into one end 42 of the grid member 32 that needs to be lengthened. In this alternative embodiment, the "swedged end" 40 of the grid extension 38 is an end that has been crimped down or radially reduced to fit within the end 42 of a normal grid member 32 (i.e., the outer diameter of the swedged end 40 has been forcibly reduced to be approximately the same size as the inner diameter of the unswedged end 42 of the grid member 32).

Alternatively, an end 42' of the grid member 32 that is too short to span the window well opening for a particular installation may be swedgedly expanded to accept an unswedged end 40 of a grid extension 38'. In this alternative embodiment, the "swedged end" 42' is an end of the short grid member 32 (or 36) that has been stretched out or radially expanded to receive an unchanged end 40' of a section of a normal grid member that is being used as the grid extension 38' to lengthen the grid member 32 (or 36) comprising part of the cover grid 12 (i.e., the inner diameter of the swedged end 42' has been forcibly expanded to be approximately the same size as the outer diameter of the unswedged end 40' of the grid extension 38'). Clearly, other alternatives are possible. For example, the end of the grid extension may be swedgedly expanded, and the end of the grid member left unswedged; or the end of the grid extension may be left unswedged, and the end of the grid member may be swedgedly reduced. These grid extensions 38, 38' makes it possible to install the cover grid 12 over a relatively larger window well 16, even when the first grid member 36, for example, was shortened during a prior installation of the cover grid 12 over a relatively smaller window well 16.

Desirably, depending upon the size of the window well opening, one or more cross members 34 (two are shown in FIGS. 1 and 2) may be present. In the embodiment depicted in FIGS. 1 and 2, the two cross members 34 extend substantially perpendicularly across the grid members 32, 36, providing structural support while also controlling the width of the gap between adjacent grid members. As explained further below, the rear grid member 36 (i.e., the one most closely adjacent to a wall 26 of the building) may be shorter than (i.e., inset longitudinally from the ends of) the other grid members 32, as explained further below in connection with, for example, FIGS. 5-7.

Figure 3:
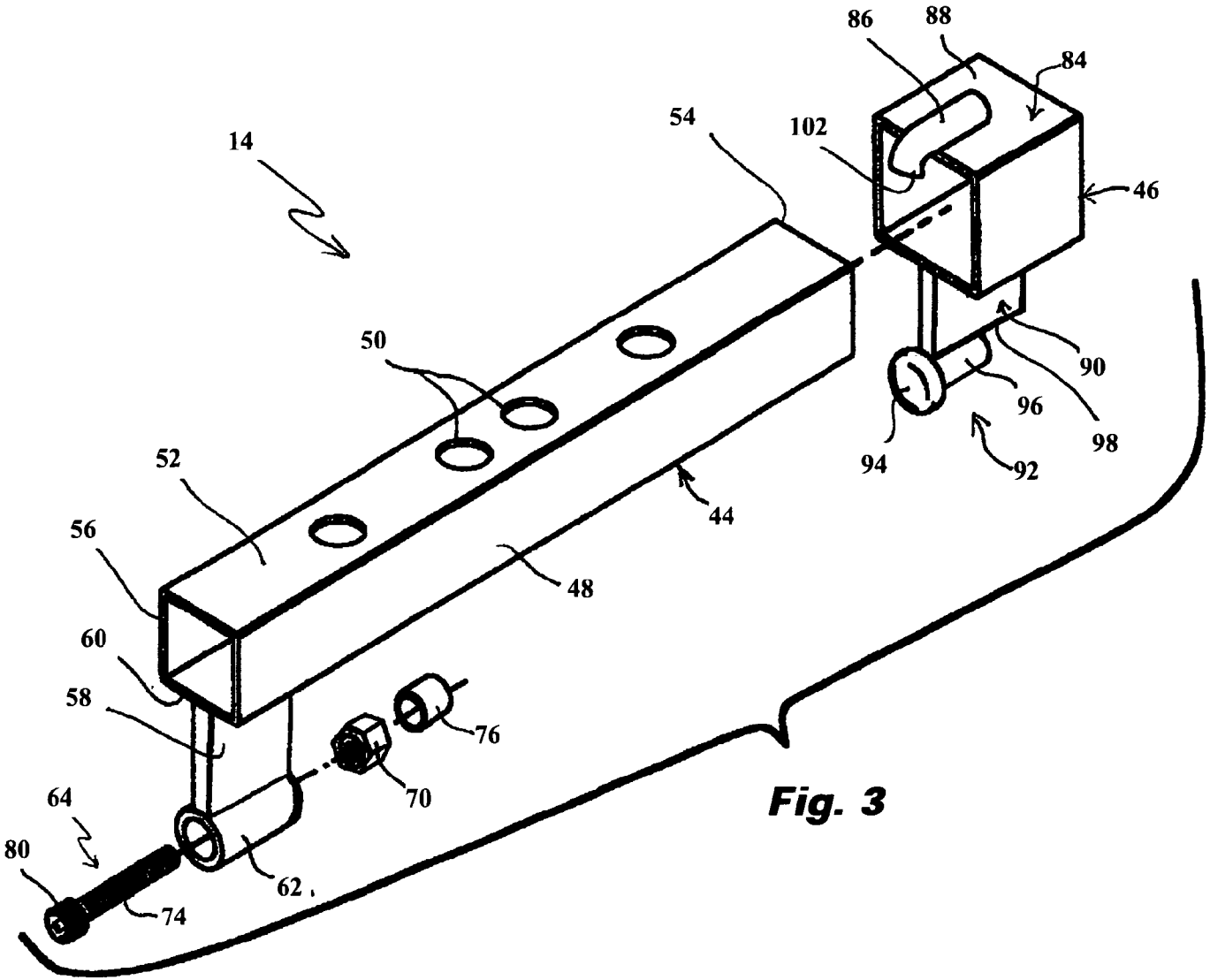
FIG. 3 is an enlarged, isometric, exploded view of one adjustable mount according to the present invention.

FIG. 3 is an exploded, isometric view of one of the adjustable, locking grid mounts or hinges 14 depicted in FIGS. 1 and 2. As shown in this figure, each adjustable mount comprises a grid sleeve unit 44 and a lock keeper 46. The grid sleeve unit 44 comprises a ported sleeve member 48 having one or more anchor ports 50 through an upper surface 52 of the ported sleeve member 48. The ported sleeve has a proximal end 54 and a distal end 56. As explained further below in connection with FIG. 4, the proximal end of the ported sleeve member may be slid onto the rear grid member 36 of the cover grid during installation. If desired, a boss or knob (not shown) could be present at the proximal end of the ported sleeve member to prevent the lock keeper from slipping off of the proximal end 54 of the ported sleeve member 48. This would make it more difficult to misplace components of the system during shipping and assembly since the components could not become inadvertently separated from each other.

Figure 4:
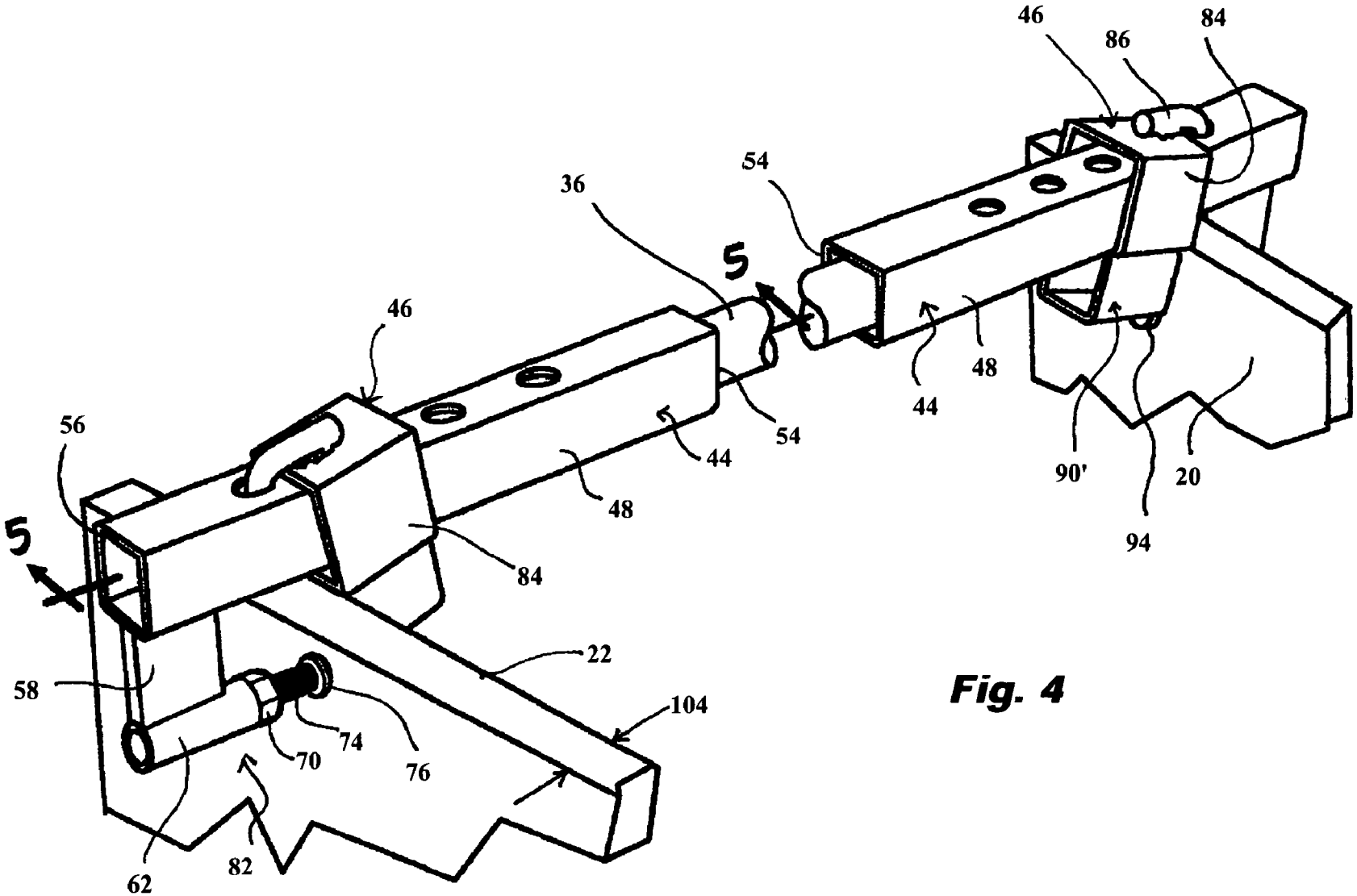
FIG. 4 is an enlarged, fragmentary, isometric view of two adjustable mounts according to the present invention in position on a rear grid member.

As depicted in FIGS. 3 and 4, a mounting member or projection 58 extends downwardly from a lower surface 60 of the ported sleeve member. A security tube 62 is affixed to (e.g., by welding) a lower edge of the mounting member. The security tube 62 makes it difficult to rotate the mounting bolt 64 without a specialized wrench head (see, e.g. 66, 68 in FIGS. 8 and 9, respectively) as described further below. An internally threaded member 70 is secured to one end of the security tube (see also FIG. 4). Alternatively, rather than having an internally threaded member secured to one end of the security tube as depicted in FIGS. 4-7, the inner surface 72 (FIG. 7) (or at least a portion of the inner surface) of the security tube may itself be threaded. The internally threaded member receives a threaded shaft 74 of the bolt 64 depicted in FIG. 3, which permits the cover grid to be securely attached to a leg or side wall 20, 22 of the window well 16 as explained further below. In the embodiment depicted, the bolts used to secure the adjustable mounts to the sidewalls of the window well are ⅜-inch, hexagonal machine head, prison bolts, which are discussed further below in connection with FIGS. 8 and 9.

Figure 5:
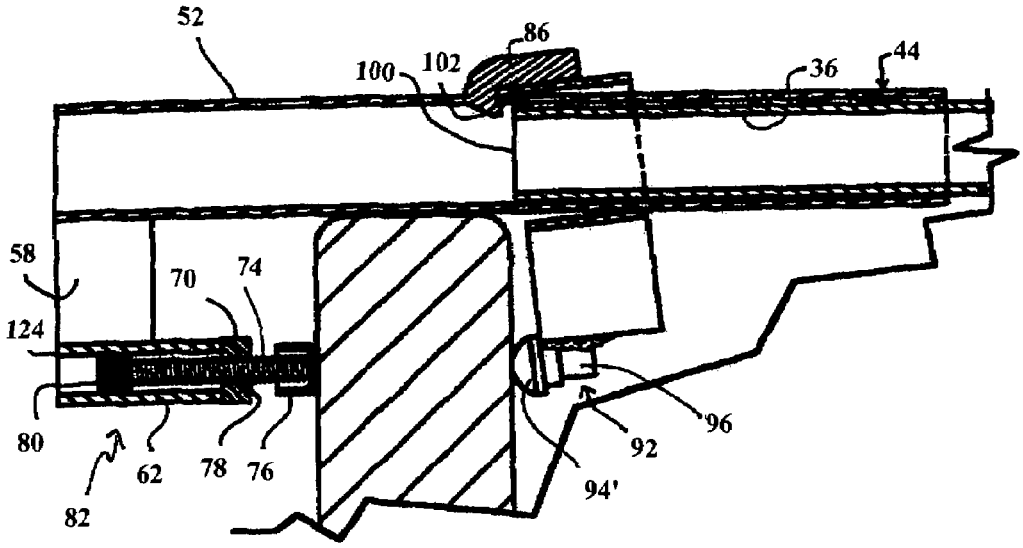
FIGS. 5-7, depict an adjustable mount according to the present invention affixed to three differently configured window well sidewalls.
Figure 6:
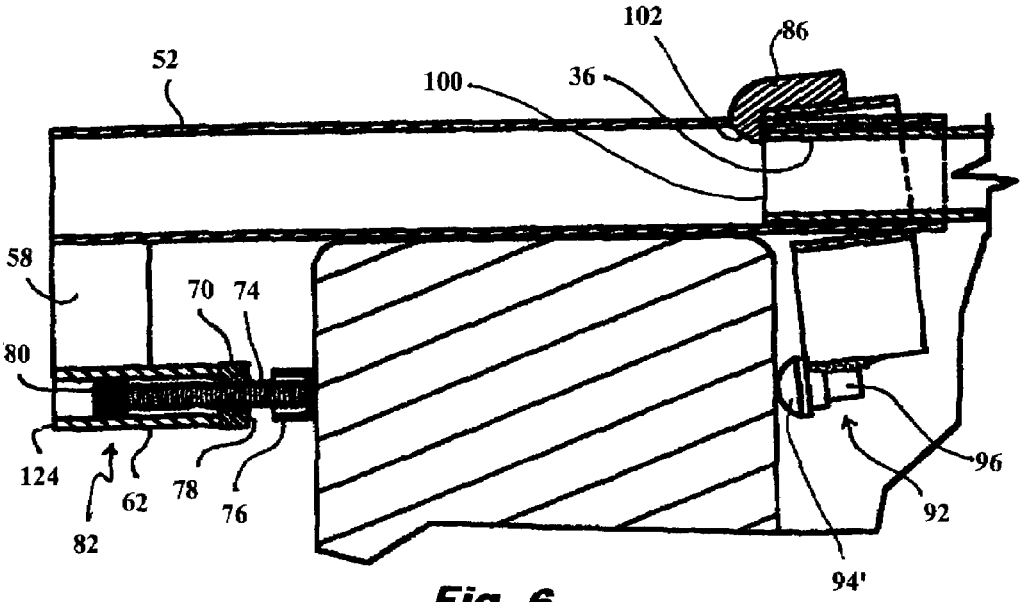
Figures 7, 8, 9:
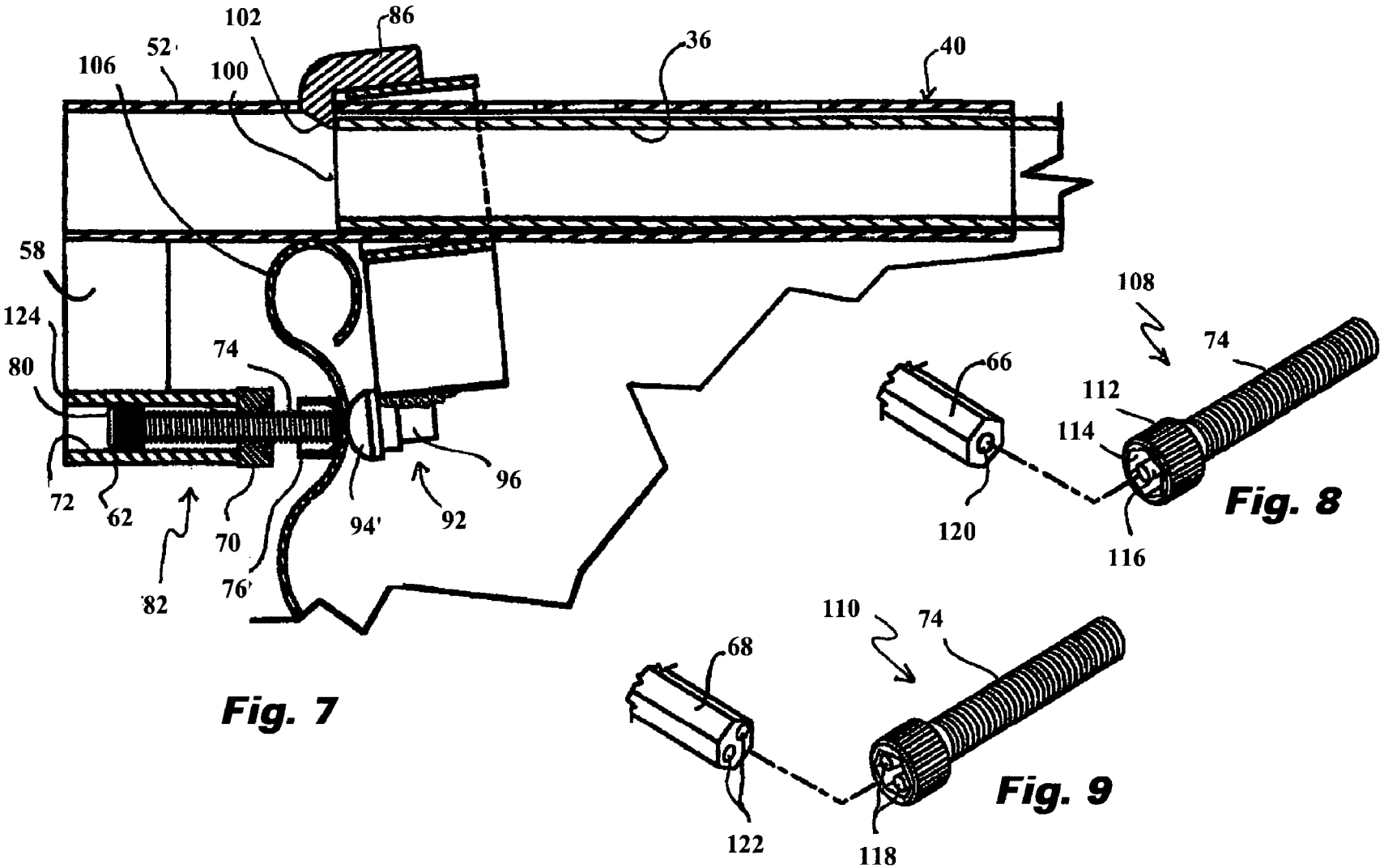
FIG. 8 is an isometric view of a theft-deterrent cap screw used in a first embodiment of the present invention and a wrench head for turning this screw.
FIG. 9 is an isometric view of a theft-deterrent cap screw used in a second embodiment of the present invention and a wrench head for turning this screw.

Also depicted in FIG. 3 is a thread cap 76 (see also FIGS. 5-7). As explained further below, the thread cap 76 may serve a couple of different purposes. The thread cap, for example, may be frictionally engaged on the end of the threaded shaft 74 that protrudes from an inward end 78 (FIGS. 5 and 6) of the security tube when the adjustable mount is installed. In this role, the thread cap 76 protects the threads of the threaded shaft 74 as the adjustable mount 14 is secured to a window well sidewall. By protecting the threads with a thread cap, the threaded shaft 74 may be fully removed from the internally threaded member mounted to the security tube, if desired. The thread cap may be able to spin on the threads so that the thread cap remains relatively fixed against the side wall of a window well 16 as the threaded shaft is tightened while mounting a cover grid to a window well. Alternatively, the thread cap 76 may be welded or otherwise affixed to the threaded shaft. In this latter configuration, a head 80 of the threaded shaft or bolt prevents the bolt from being threaded completely through the security tube, and the thread cap prevents the bolt from being fully removed from the security tube. This makes it more difficult to lose or misplace parts of the window well covering system 10. In the embodiment depicted in FIG. 3, the security tube, the internally-threaded member 70, the bolt 64, and the thread cap together comprise a first pressing portion 82 (see FIG. 4). Clearly, however, the first pressing portion 82 could be differently configured as long as it permits mounting of the adjustable mount to the window well as described more fully below.

Continuing to refer most specifically to FIG. 3, further details concerning the lock keeper 46 are described next. The lock keeper 46, according to this embodiment, includes a sliding collar 84, which is adapted to slide along the ported sleeve member and which may rock slightly on the ported sleeve member as explained further below. A cleat or anchor 86 is affixed to an upper surface 88 of the sliding collar. A second mounting member or projection 90 extends downwardly from a lower surface of the sliding collar. A second pressing portion 92 is supported by the second mounting member or projection 90. In the embodiment depicted in FIG. 3, the second pressing portion comprises a button or knob-like structure 94 and a button support 96. In this embodiment, the button support is mounted to a lower edge 98 of the second mounting member or projection 90.

The first mounting member or projection 58 and the second mounting member or projection 90 provides additional leverage for the adjustable mount to be secured to the sidewall of the window well. It may be possible, however, to directly secure the first pressing portion 82 to the lower surface 60 of the ported sleeve member 48 and to secure the second pressing portion 92 to the lower surface of the sliding collar 84. Similar to the thread cap, the button comprising part of the second pressing portion in the embodiment depicted in FIG. 3 may or may not rotate on the button support 96. Since the second pressing portion comes into contact with the sidewall of the window well by sliding the sliding collar along the ported sleeve member as described further below, whereas the first pressing portion is typically rotated into contact with the opposite side of the sidewall of the window well as also described further below, even if the button is able to rotate on the button support, it may not do so during installation or removal of the adjustable mount.

FIG. 4 is a fragmentary, isometric view, depicting two adjustable mounts, one mounted to each sidewall of a window well. As shown in this figure, the ported sleeve members are slid over the ends of the rear grid member (see also FIGS. 1 and 2). In order to secure the adjustable mounts, and thus the cover grid, to the window well, the cover grid and the adjustable mounts are first placed on top of, or along the upper edge of, the window well. With the cover grid approximately centered left to right on the upper edge of the window well, the bottom surfaces of the ported sleeve members ride on the upper edge of the window well sidewalls.

As shown to best advantage in FIGS. 5-7, the first or rear grid member may be cut so that it approximately spans the gap between the inside of the first and second window well sidewalls. The sliding collar for each adjustable mount is then positioned so that the cleat or anchor 86 extends into the appropriate anchor port 50 that results in the second pressing portion 92 being against the inside surface of the sidewall of the window well. FIGS. 5-7 depict this configuration, with the second pressing portion against the inside surface of the sidewall of the window well, and the sliding collar rocked slightly causing the cleat or anchor to extend into an anchor port 50. In this configuration, the cleat or anchor not only sets the position of the sliding collar along the ported sleeve member, but also extends into the ported sleeve member adjacent to a longitudinal end 100 of the rear grid member. In one embodiment, the cleat or anchor at each end of the first or rear grid member is within one-quarter inch or less of the longitudinal end 100 of the first grid member once the window well cover is fully installed. The hook portions 102 of the cleats 86 may thereby keep the cover grid from moving laterally by keeping the grid member to which the adjustable mounts are attached from moving laterally. In this manner, the cleats stabilize and secure the side-to-side position of the cover grid over the window well opening.

Thus, the grid member anchor mounts are first placed in the correct approximate position over the window well covering, and then the sliding collars are appropriately placed along the ported sleeve members. Next, the bolts mounted in the security tubes are tightened until each sidewall of the window well is pinched between a first pressing portion and a second pressing portion. The threaded cap screws are tightened until the adjustable mounts, and thus the cover grid, are securely mounted to the window well. In this fully-mounted configuration, it remains possible to pivot the cover grid between its open configuration (FIG. 1) and its closed configuration (FIG. 2), while deterring unintended removal of the window well covering from the window well.

FIGS. 4 and 5-7 depict the versatility of the adjustable mounts by showing how they may be used to affix a grid cover to window wells having a variety of different sidewall thicknesses 104. In FIG. 4, the sidewalls of the window well have a first thickness. The window well sidewall depicted in FIG. 5 is thicker than the sidewalls depicted in FIG. 4, and the window well sidewall depicted in FIG. 6 is even thicker than the sidewall depicted in FIG. 5. In FIG. 7, the adjustable mount has been affixed to a typical tin window well 106. The ability of the adjustable mounts according to the present invention to attach to different window well sidewall thicknesses is limited only by the position of the anchor ports 50 through the upper surface portion 52 of the ported sleeve member. Since window wells are generally manufactured in only a few different sizes (see above discussion), it is possible to put sufficient anchor ports into ported sleeve members to enable a single adjustable mount to be adapted to a variety of different standard window well configurations. Further, if a non-standard window well were to be used, it is possible to adapt the ported sleeve member to work on the non-standard window well.

FIGS. 8 and 9 depict theft-deterrent cap screws 108, 110 that may be used for the bolts 64 that are clearly depicted in FIGS. 3-7. These theft-deterrent cap screws include special features making them difficult to turn without specialized wrench heads 66, 68. For example, the theft-deterrent cap screw depicted in FIG. 8 comprises a knurled head 112 with a hexagonal recess 114 in it. An interference pin 116 is present in the hexagonal recess. This interference pin makes it impossible to use a standard Allen wrench, for example, to turn the cap screw. Similarly, the theft-deterrent cap screw depicted in FIG. 9 has a pair of interference pins 118 in a hexagonal recess 114 in the cap screw head. Again, a special wrench head is required to be able to turn the theft-deterrent cap screw depicted in FIG. 9. The special wrenches 66, 68 depicted in FIGS. 8 and 9 are longitudinally-operative tools. A "longitudinally-operative tool" as used herein is a tool that turns a bolt or screw by engaging one or more structures (like the hexagonal recess 114 and/or the interference pin 116, 118) at a longitudinal end of the bolts.

When the theft-deterrent cap screws depicted in FIGS. 8 and 9 are threaded into the internally threaded member 70 shown in, for example, FIG. 7, the head of the cap screw rides relatively snugly inside of the security tube. Without the required special wrench 66, 68, which includes one or more channels 120, 122 to accommodate one or more interference pins 116, 118, respectively, it is nearly impossible to rotate the theft-deterrent cap screw within the internally threaded member.

Further, since the head of each theft-deterrent cap screw rides snugly within a security tube, it is impossible for someone to turn the cap screw by holding onto the outer surface of the cap screw head. The knurled cap screw heads depicted in FIGS. 3 and 5-9 make it easier to start the cap screw into the threaded member (i.e., before the head passes an outward end 124 of a security tube and becomes fully recessed within the security tube) and inhibits undo friction and binding between the cap screw head 80 and the inner wall of the security tube after the cap screw head is fully recessed within the security tube. Although two embodiments of theft-deterrent cap screws are depicted in the figures, several different embodiments are possible and, if theft deterrence is not important to a user, regular cap screws may be used. Although theft-deterrent cap screws do not prevent someone from removing the window well covering according to the present invention, it makes it difficult for someone to use standard tools to indiscriminately remove or adjust the window well covering.

Although a number of embodiments of this invention have been described above with a certain degree of particularity, those skilled in the art could make numerous alterations to the disclosed embodiments without departing from the spirit or scope of this invention. For example, the drawings depict two different embodiments for the mounting member or projection attached to the lower surface of the sliding collars. In particular, FIG. 3 shows a mounting member 90 that comprises a single, solid piece of metal, whereas FIG. 4 depicts a mounting member 90' that comprises three walls in a U-shaped configuration attached to the lower surface of the sliding collar. Clearly, the mounting member for the security tube could have additional, different configurations from those shown. Also, the buttons and button supports could have configurations different from what is shown in the figures. FIG. 3 shows one type of button 94 and FIGS. 5-7 show a different type of button 94'. Similarly, FIG. 3 shows a first configuration for a button support, and FIG. 5-7 depict a second configuration for the button support. Further, although the adjustable mounts are shown being used to secure a grid member of a cover grid horizontally, the adjustable mounts could be used to vertically mount a cover grid or gate. In yet another alternative within the scope of the present invention as described above, the cover grid could also be configured to open away from the structural wall of the building by, for example, attaching the adjustable mounts near the intersection of the window well sidewalls and the window well front wall. Finally, all directional references (e.g., upper, lower, upward, downward, left, right, leftward, rightward, top, bottom, above, below, vertical, horizontal, clockwise, and counterclockwise) are only used for identification purposes to aid the reader's understanding of the present invention, and do not create limitations, particularly as to the position, orientation, or use of the invention. It is intended that all matter contained in the above description or shown in the accompanying drawings shall be interpreted as illustrative only and not limiting. Changes in detail or structure may be made without departing from the spirit of the invention as defined in the appended claims.

What is claimed is:

1. A covering, removably mountable to a top edge of a window well, the covering comprising a cover grid having a cover grid edge; and at least one adjustable grid mount adapted to removably attach said cover grid to the window well by hingedly attaching said cover grid edge to the top edge of the window well, wherein said at least one adjustable grid mount further comprises a grid sleeve unit slideably attached to said cover grid edge; and a lock keeper slideably mounted on said grid sleeve unit;

wherein said grid sleeve unit comprises a ported sleeve member having a proximal end, a distal end, and an upper surface; and wherein at least one anchor port extends through said upper surface of said ported sleeve member;

wherein said cover grid comprises a plurality of grid members including an edge grid member, and wherein said cover grid edge comprises said edge grid member;

wherein said covering further comprises a first pressing portion mounted to said distal end of said ported sleeve member; and a second pressing portion mounted to said lock keeper, wherein said first pressing portion is adapted to pinch a sidewall of the window well against said second pressing portion; and wherein said lock keeper further comprises a sliding collar slideably mounted on said ported sleeve member and adapted to slide said second pressing portion into and out of engagement with a first side of the window well sidewall.

2. The covering of claim 1, wherein said first pressing portion is adapted to threadedly move into and out of contact with a second side of the window well sidewall.

3. The covering of claim 1, wherein said sliding collar is adapted to rock on said ported sleeve member; wherein said sliding collar further comprises an upper surface; wherein said lock keeper further comprises a cleat affixed to said upper surface of said sliding collar; and wherein when said sliding collar rocks, said cleat is adapted to rock into and out of engagement with said at least one anchor port to thereby set a position of said second pressing portion relative to the first side of the window well sidewall.

4. A covering, removably mountable to a top edge of a window well the window well having a window well wall, the covering comprising a cover grid having a cover grid edge; and at least one adjustable grid mount adapted to removably attach said cover grid to the window well by hingedly attaching said cover grid edge to the top edge of the window well, wherein said at least one adjustable grid mount further comprises a grid sleeve unit slideably attached to said cover grid edge; and a lock keeper slideably mounted on said grid sleeve unit;

wherein said grid sleeve unit comprises a ported sleeve member having a proximal end, a distal end, and an upper surface; and wherein at least one anchor port extends through said upper surface of said ported sleeve member;

wherein said grid sleeve unit further comprises a first mounting member extending downwardly from a lower surface of said ported sleeve member, wherein a first pressing portion is supported by said first mounting member wherein said lock keeper further comprises a second mounting member extending downwardly from a lower surface, wherein a second pressing portion is supported by said second mounting member; and wherein said first and second pressing portions are adapted to sandwich the window well wall therebetween.

5. The covering of claim 4, wherein said second pressing portion further comprises a button and a button support, and wherein said button support is mounted to a lower edge of said second mounting member.

6. The covering of claim 4, wherein said first pressing portion further comprises a security tube mounted to a lower edge of said first mounting member, and wherein a mounting bolt is threadedly engageable with said security tube.

7. The covering of claim 6, wherein said security tube is internally threaded, and wherein said mounting bolt is threadedly engageable with said internal threads of said security tube.

8. The covering of claim 6, wherein an internally-threaded member is secured to one end of said security tube, and wherein said mounting bolt is threadedly engageable with said internal threads of said internally-threaded member.

9. A pivotable cover system for alternatingly covering and uncovering a window well, the cover system comprising a pivotable cover grid comprising a plurality of grid members, including a mounting grid member; and a pair of adjustable mounts, including a first adjustable mount and a second adjustable mount, wherein said first and second adjustable mounts are removably attached to said mounting grid member of said pivotable cover grid, and wherein said first and second adjustable mounts are adapted to attach said pivotable cover grid to the window well;

wherein each of said first and second adjustable mounts further comprises a grid sleeve unit slideably mounted on said mounting grid member; and a lock keeper slideably mounted on said grid sleeve unit;

wherein each grid sleeve unit comprises a ported sleeve member having a proximal end, a distal end, an upper surface, and a lower surface, wherein at least one anchor port extends through said upper surface of said ported sleeve member; and wherein said lower surface of each said ported sleeve member is adapted to ride on an upper edge of a window well sidewall; and wherein said lock keeper further comprises a sliding collar having a lower surface and being slideably mounted on said ported sleeve member, and wherein each of said first and second adjustable mounts further comprises a first pressing portion secured to said lower surface of said ported sleeve member and adapted to adjustably contact a second side of the window well sidewall; and a second pressing portion secured to said lower surface of said sliding collar and adapted to adjustably contact a first side of the window well sidewall.

10. The pivotable cover system of claim 9, wherein said first pressing portion further comprises a theft-deterrent cap screw shieldedly mounted in a security tube.

11. The pivotable cover system of claim 10, wherein said theft-deterrent cap screws are removable only by a longitudinally-operative tool extending into said security tube.

* * * * *